US006048373A

United States Patent [19]

Malfer et al.

[11] Patent Number: 6,048,373

[45] Date of Patent: Apr. 11, 2000

[54] FUELS COMPOSITIONS CONTAINING POLYBUTENES OF NARROW MOLECULAR WEIGHT DISTRIBUTION

[75] Inventors: Dennis J. Malfer; William J. Colucci, both of Glen Allen, Va.

[73] Assignee: Ethyl Corporation, Richmond, Va.

[21] Appl. No.: 09/201,113

[22] Filed: Nov. 30, 1998

[51] Int. Cl.[7] ..... C10L 1/22; C10L 1/16

[52] U.S. Cl. ..... 44/415; 44/459

[58] Field of Search ..... 44/459, 415

[56] References Cited

U.S. PATENT DOCUMENTS

| | | | |
|---|---|---|---|
| 3,676,089 | 7/1972 | Morris et al. | 44/459 |
| 3,807,976 | 4/1974 | Polss | 44/459 |
| 3,838,990 | 10/1974 | Mieville | 44/459 |
| 3,907,518 | 9/1975 | Machleder et al. | 44/459 |
| 3,948,619 | 4/1976 | Worrel | 44/415 |
| 4,231,759 | 11/1980 | Udelhofen et al. | 44/75 |
| 4,357,148 | 11/1982 | Graiff | 44/459 |
| 4,659,336 | 4/1987 | Sung et al. | 44/459 |
| 5,114,435 | 5/1992 | Abramo et al. | 44/348 |
| 5,514,190 | 5/1996 | Cunningham et al. | 44/415 |
| 5,558,683 | 9/1996 | Loper | 44/415 |
| 5,634,951 | 6/1997 | Colucci et al. | 44/415 |
| 5,697,988 | 12/1997 | Malfer et al. | 44/415 |

*Primary Examiner*—Ellen M. McAvoy
*Attorney, Agent, or Firm*—Dennis H. Rainear; Thomas Hamilton

[57] ABSTRACT

A fuel composition comprising a spark-ignition fuel; a Mannich detergent; and a polybutene having a molecular weight distribution of 1.4 or less.

22 Claims, No Drawings

FUELS COMPOSITIONS CONTAINING POLYBUTENES OF NARROW MOLECULAR WEIGHT DISTRIBUTION

FIELD OF THE INVENTION

The present invention relates to new fuel compositions and methods for controlling intake valve deposits and minimizing valve sticking in spark-ignition internal combustion engines.

BACKGROUND OF THE INVENTION

Over the years considerable work has been devoted to additives for controlling (preventing or reducing) deposit formation in the fuel induction systems of spark-ignition internal combustion engines. In particular, additives that can effectively control intake valve deposits represent the focal point of considerable research activities in the field and despite these efforts, further improvements are desired.

U.S. Pat. No. 4,231,759 (Udelhofen et al.) discloses liquid hydrocarbon fuels containing high molecular weight Mannich detergents and optionally, a non-volatile hydrocarbon carrier fluid. Preferred carrier fluids include polybutene and polypropylene. This reference fails to teach the use of polybutenes having a narrow molecular weight distribution or the advantages obtained by said use.

U.S. Pat. No. 5,514,190 (Cunningham et al.) discloses gasoline compositions containing Mannich detergents, poly (oxyalkylene) carbamates and poly (oxyalkylene) alcohols. These compositions may additionally contain hydrocarbon diluents, solvents or carriers including polymers of lower hydrocarbons such as polypropylene, polyisobutylene and ethylene-1-olefin copolymers. This reference fails to teach the use of polybutenes having a narrow molecular weight distribution or the advantages obtained by said use.

U.S. Pat. No. 5,634,951 (Colucci et al.) discloses gasoline compositions containing Mannich detergents. This patent teaches that carrier fluids, including liquid polyalkenes, may be added to the compositions. This reference fails to teach the use of polybutenes having a narrow molecular weight distribution or the advantages obtained by said use.

SUMMARY OF THE INVENTION

The present invention is directed to a fuel composition comprising (a) a spark-ignition internal combustion fuel; (b) a Mannich detergent; and (c) a polybutene having a molecular weight distribution (Mw/Mn) of 1.4 or below. Further, this invention is directed to methods of controlling intake valve deposits and minimizing valve sticking in spark-ignition internal combustion engines.

DETAILED DESCRIPTION OF THE INVENTION

The polybutenes of the present invention have a molecular weight distribution (Mw/Mn) of 1.4 or below. Preferred polybutenes have a number average molecular weight (Mn) of from about 500 to about 2000, preferably 600 to about 1000, as determined by gel permeation chromatography (GPC). The polybutenes of the present invention may be prepared by any method yielding the desired molecular weight and a molecular weight distribution of 1.4 or below. The methods of obtaining narrow molecular weight distribution polybutenes include proper catalyst selection, such as using $BF_3$ to form high reactivity polybutenes, and the use of high purity refinery streams to obtain polymers having narrow molecular weight distributions.

High reactivity polybutenes have relatively high proportions (i.e., >30%) of polymer molecules having a terminal vinylidene group. The term "polybutene", as used throughout this disclosure, includes polymers made from "pure" or "substantially pure" 1-butene or isobutene, and polymers made from mixtures of two or all three of 1-butene, 2-butene and isobutene as well as including polymers containing minor amounts, preferably less than 10% by weight, more preferably less than 5% by weight, of $C_2$, $C_3$, and $C_5$ and higher olefins as well as diolefins. In a preferred embodiment, the polybutene is a polyisobutene wherein at least 90% by weight, preferably at least 95% by weight, of the polymer is derived from isobutene.

The Mannich detergents of the present invention are obtained by reacting alkyl-substituted hydroxyaromatic compounds, aldehydes and amines. The alkyl-substituted hydroxyaromatic compounds, aldehydes and amines used in the preparation of the Mannich detergents may be any such compounds known and applied in the art, in accordance with the foregoing limitations.

Representative alkyl-substituted hydroxyaromatic compounds that may be used in forming the present Mannich detergents are polypropylphenol (formed by alkylating phenol with polypropylene), polybutylphenols (formed by alkylating phenol with polybutenes and/or polyisobutylene), and polybutyl-co-polypropylphenols (formed by alkylating phenol with a copolymer of butylene and/or butylene and propylene). Other similar long-chain alkylphenols may also be used. Examples include phenols alkylated with copolymers of butylene and/or isobutylene and/or propylene, and one or more mono-olefinic comonomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene or said butenes may be aliphatic and can also contain non-aliphatic groups, e.g., styrene, o-methylstyrene, p-methylstyrene, divinyl benzene and the like. Thus in any case the resulting polymers and copolymers used in forming the alkyl-substituted hydroxyaromatic compounds are substantially aliphatic hydrocarbon polymers.

Polybutylphenol (formed by alkylating phenol with polybutylene) is preferred. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol reactant.

The alkylation of the hydroxyaromatic compound is typically performed in the presence of an alkylating catalyst such as $BF_3$ at a temperature in the range of about 50 to about 200° C. The long chain alkyl substituents on the benzene ring of the phenolic compound are derived from polyolefin having a number average molecular weight (Mn) of from about 500 to about 3000 (preferably from about 500 to about 2000) as determined by gel permeation chromatography (GPC). It is also preferred that the polyolefin used have a polydispersity (weight average molecular weight/number average molecular weight) in the range of about 1 to about 4, preferably from about 1 to about 2, as determined by GPC.

The Mannich detergent may be, and preferably is, made from a long chain alkylphenol. However, other phenolic compounds may be used including high molecular weight alkyl-substituted derivatives of resorcinol, hydroquinone, cresol, catechol, xylenol, hydroxydiphenyl, benzylphenol, phenethylphenol, naphthol, tolylnaphthol, among others. Preferred for the preparation of the Mannich detergents are the polyalkylphenol reactants, e.g., polypropylphenol and polybutylphenol whose alkyl group has a number average molecular weight of 650–1200, while the most preferred type of alkyl groups is a polybutyl group derived from polybutylene having a number average molecular weight in the range of about 650–950.

The preferred configuration of the alkyl-substituted hydroxyaromatic compound is that of a para-substituted mono-alkylphenol. However, any alkylphenol readily reactive in the Mannich condensation reaction may be employed. Thus, Mannich detergents made from alkylphenols having only one ring alkyl substituent, or two or more ring alkyl substituents are suitable for use in this invention. The long chain alkyl substituents may contain some residual unsaturation, but in general, are substantially saturated alkyl groups.

Representative amine reactants include, but are not limited to, alkylene polyamines having at least one suitably reactive primary or secondary amino group in the molecule. Other substituents such as hydroxyl, cyano, amido, etc., can be present in the polyamine. In a preferred embodiment, the alkylene polyamine is a polyethylene polyamine. Suitable alkylene polyamine reactants include ethylene diamine, diethylene triamine, triethylene tetramine, tetraethylene pentamine, pentaethylene hexamine, hexaethylene heptamine, heptaethylene octamine, octaethylene nonamine, nonaethylene decamine, decaethylene undecamine and mixtures of such amines having nitrogen contents corresponding to alkylene polyamines of the formula $H_2N—(CH_2—CH_2—NH—)_nH$, where n is an integer of from 1 to 10. Corresponding propylene polyamines are also suitable reactants. The alkylene polyamines may be obtained by the reaction of ammonia and dihalo alkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbon atoms are suitable alkylene polyamine reactants.

In another preferred embodiment of the present invention, the amine is an aliphatic diamine having one primary or secondary amino group and one tertiary amino group in the molecule. Examples of suitable polyamines include N,N,N", N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), N,N-dihydroxyalkyl- alpha, omega-alkylenediamines (one terminal tertiary amino group and one terminal primary amino group), N,N,N'-trihydroxyalkyl- alpha, omega-alkylenediamines (one terminal tertiary amino group and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N, N-dialkyl- alpha, omega-alkylenediamine, such as those having from 3 to about 6 carbon atoms in the alkylene group and from 1 to about 12 carbon atoms in each of the alkyl groups, which most preferably are the same but which can be different. Most preferred is N,N-dimethyl-1, 3-propanediamine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)-1-methyl-1,2-ethanediamine, N-(tert-butyl)- 1-methyl-1,3-propanediamine, and 3,5-di(tert-butyl) aminoethylpiperazine.

Representative aldehydes for use in the preparation of the Mannich detergents include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkyl-substituted hydroxyaromatic compound, the amine(s) and the aldehyde may be conducted at a temperature in the range of about 40° to about 200° C. The reaction can be conducted in bulk (no diluent or solvent) or in a solvent or diluent. Water is evolved and can be removed by azeotropic distillation during the course of the reaction. Typically, the Mannich detergents are formed by reacting the alkyl-substituted hydroxyaromatic compound, amine and aldehyde in the molar ratio of 1.0:0.5-2.0:1.0-3.0, respectively.

The proportion of the polybutene having a molecular weight distribution of 1.4 or less relative to the Mannich detergent in the preferred additive concentrates and fuel compositions of this invention is such that the fuel composition when consumed in an engine results in improved intake valve cleanliness as compared to intake valve cleanliness of the same engine operated on the same composition except for being devoid of the polybutene. Thus, in general, the weight ratio of polybutene to Mannich detergent on an active ingredient basis, i.e., excluding solvent(s), if any, used in the manufacture of the Mannich detergent, will usually fall within the range of about 0.1:1 to about 1: 1, and preferably within the range of about 0.2:1 to about 0.7:1.

When formulating the fuel compositions of this invention, the Mannich detergent and the polybutene (with our without other additives) are employed in amounts sufficient to reduce or inhibit deposit formation in an internal combustion engine. Thus the fuels will contain minor amounts of the Mannich detergent and of the polybutene proportioned as above that prevent or reduce formation of engine deposits, especially intake system deposits, and most especially intake valve deposits in spark-ignition internal combustion engines. Generally speaking the fuels of this invention will contain, on an active ingredient basis, an amount of Mannich detergent in the range of about 5 to about 50 ptb (pounds by weight of additive per thousand barrels by volume of fuel), and preferably in the range of about 15 to about 40 ptb. In the preferred fuel compositions of the invention, the amount of polybutene(s) having a MWD of 1.4 or less will usually fall within the range of about 0.5 to about 50 ptb, and preferably in the range of about 1.5 to about 40 ptb.

The fuel compositions of the present invention may contain supplemental additives in addition to the Mannich detergents and the polybutenes described above. Said supplemental additives include additional detergents, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives and combustion improvers.

Cyclopentadienyl manganese tricarbonyl compounds such as methylcyclopentadienyl manganese tricarbonyl are preferred combustion improvers because of their outstanding ability to reduce tailpipe emissions such as NOx and smog forming precursors and to significantly improve the octane quality of gasolines, both of the conventional variety and of the "reformulated" types.

The base fuels used in formulating the fuel compositions of the present invention include any base fuels suitable for use in the operation of spark-ignition internal combustion engines such as leaded or unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the present invention include methanol, ethanol, isopropanol, t-butanol, mixed C1 to C5 alcohols, methyl tertiary butyl ether, tertiary amyl methyl ether, ethyl tertiary butyl ether and mixed ethers. Oxygenates, when used, will normally be present in the base fuel in an amount below about 25% by volume, and preferably in an amount that provides an oxygen content in the overall fuel in the range of about 0.5 to about 5 percent by volume.

In a preferred embodiment, the Mannich detergents and the polybutenes of this invention are used in combination with a liquid carrier or induction aid. Such carriers can be of various types, such as for example liquid poly-α-olefin oligomers, mineral oils, liquid poly(oxyalkylene) compounds, liquid alcohols or polyols, polyalkenes other than the polybutenes described above, liquid esters, and similar liquid carriers. Mixtures of two or more such carriers can be employed.

Preferred liquid carriers include 1) a mineral oil or a blend of mineral oils that have a viscosity index of less than about 120, 2) one or more poly-α-olefin oligomers, 3) one or more poly(oxyalkylene) compounds having an average molecular weight in the range of about 500 to about 3000, 4) polyalkenes or 5) a mixture of any two, three or all four of 1), 2), 3) and 4). The mineral oil carriers that can be used include paraffinic, naphthenic and asphaltic oils, and can be derived from various petroleum crude oils and processed in any suitable manner. For example, the mineral oils may be solvent extracted or hydrotreated oils. Reclaimed mineral oils can also be used. Hydrotreated oils are the most preferred. Preferably, the mineral oil used has a viscosity at 40° C. of less than about 1600 SUS, and more preferably between about 300 and 1500 SUS at 40° C. Paraffinic mineral oils most preferably have viscosities at 40° C. in the range of about 475 SUS to about 700 SUS. For best results, it is highly desirable that the mineral oil have a viscosity index of less than about 100, more preferably, less than about 70 and most preferably in the range of from about 30 to about 60.

The poly-α-olefins (PAO) which are included among the preferred carrier fluids are the hydrotreated and unhydrotreated poly-α-olefin oligomers, i.e., hydrogenated or unhydrogenated products, primarily trimers, tetramers and pentamers of α-olefin monomers, which monomers contain from 6 to 12, generally 8 to 12 and most preferably about 10 carbon atoms. Their synthesis is outlined in *Hydrocarbon Processing*, February 1982, page 75 et seq., and in U.S. Pat. Nos. 3,763,244; 3,780,128; 4,172,855; 4,218,330; and 4,950,822. The usual process essentially comprises catalytic oligomerization of short chain linear alpha olefins (suitably obtained by catalytic treatment of ethylene). The poly-α-olefins used as carriers will usually have a viscosity (measured at 100° C.) in the range of 2 to 20 centistokes (cSt). Preferably, the poly-α-olefin has a viscosity of at least 8 cSt, and most preferably about 10 cSt at 100° C.

The poly (oxyalkylene) compounds which are among the preferred carrier fluids for use in this invention are fuel-soluble compounds which can be represented by the following formula $$R_1\text{-}(R_2\text{-}0)_n\text{-}R_3$$

wherein $R_1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted bydrocarbyl, or hydroxy-substituted hydrocarbyl group, $R_2$ is an alkylene group having 2–10 carbon atoms, preferably 2–4 carbon atoms, $R_3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 and preferably in the range of from 3 to 120 representing the number (usually an average number) of repeating alkyleneoxy groups. In compounds having multiple —$R_2$—O— groups, $R_2$ can be the same or different alkylene group and where different, can be arranged randomly or in blocks. Preferred poly (oxyalkylene) compounds are monools comprised of repeating units formed by reacting an alcohol with one or more alkylene oxides, preferably one alkylene oxide.

The average molecular weight of the poly (oxyalkylene) compounds used as carrier fluids is preferably in the range of from about 500 to about 3000, more preferably from about 750 to about 2500, and most preferably from above about 1000 to about 2000.

One useful sub-group of poly (oxyalkylene) compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being fully incorporated herein by reference.

A preferred sub-group of poly (oxyalkylene) compounds is comprised of one or a mixture of alkylpoly (oxyalkylene) monools which in its undiluted state is a gasoline-soluble liquid having a viscosity of at least about 70 centistokes (cSt) at 40° C. and at least about 13 cSt at 100° C. Of these compounds, monools formed by propoxylation of one or a mixture of alkanols having at least about 8 carbon atoms, and more preferably in the range of about 10 to about 18 carbon atoms, are particularly preferred.

The poly(oxyalkylene) carriers used in the practice of this invention preferably have viscosities in their undiluted state of at least about 60 cSt, more preferably at least about 70 cSt, at 40° C. and at least about 11 cSt, more preferably at least about 13 cSt, at 100° C. In addition, the poly (oxyalkylene) compounds used in the practice of this invention preferably have viscosities in their undiluted state of no more than about 400 cSt at 40° C. and no more than about 50 cSt at 100° C. More preferably, their viscosities will not exceed about 300 cSt at 40° C. and will not exceed about 40 cSt at 100° C. The most preferred poly (oxyalkylene) compounds will have viscosities of no more than about 200 cSt at 40° C., and no more than about 30 cSt at 100° C.

Preferred poly (oxyalkylene) compounds also include poly (oxyalkylene) glycol compounds and monoether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkylene groups in the molecule are derived from 1,2-propylene oxide. Details concerning preparation of such poly(oxyalkylene) compounds are referred to, for example, in Kirk-Othmer, *Encyclopedia of Chemical Technology*, Third Edition, Volume 18, pages 633–645 (Copyright 1982 by John Wiley & Sons), and in references cited therein, the foregoing excerpt of the Kirk-Othmer encyclopedia and the references cited therein being incorporated herein in toto by reference. U.S. Pat. Nos. 2,425,755; 2,425,845; 2,448,664; and 2,457,139 also describe such procedures, and are fully incorporated herein by reference.

The poly (oxyalkylene) compounds, when used, pursuant to this invention will contain a sufficient number of branched oxyalkylene units (e.g., methyldimethyleneoxy units and/or ethyldimethyleneoxy units) to render the poly (oxyalkylene) compound gasoline soluble.

The polyalkenes suitable for use as carrier fluids in the present invention include polybutenes having a MWD greater than 1.4, polypropene and ethylene-propylene copolymers.

In some cases, the Mannich detergent can be synthesized in the carrier fluid. In other instances, the preformed detergent is blended with a suitable amount of the carrier fluid. If desired, the detergent can be formed in a suitable carrier fluid and then blended with an additional quantity of the same or a different carrier fluid.

The additives used in formulating the preferred fuels of the present invention can be blended into the base fuel individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also use of a concentrate reduces blending time and lessens the possibility of blending errors.

Other aspects of the present invention include fuels for spark-ignition engines into which have been blended small amounts of the various compositions of the invention described herein, a fuel composition comprising a spark-ignition fuel, a Mannich detergent and a polybutene, wherein the improvement comprises using as the polybutene a polybutene having a molecular weight distribution of 1.4 or less, as well as methods for reducing intake valve deposits and eliminating valve sticking in a spark-ignition engine by fueling and/or operating the engine with the fuel composition of this invention.

EXAMPLES

The practice and advantages of this invention are demonstrated by the following examples that are presented for purposes of illustration and not limitation. In each formulation a Mannich detergent and polyol carrier fluid were used. The polybutene and total additive treat rates were as set forth in Table 1. The Mannich detergent of Examples 1* and 2 were the same and the Mannich detergent of Examples 3* and 4 were the same. The additive compositions of Examples 1* and 2 contained the Mannich detergent, carrier fluid and polybutene in a weight ratio of 0.8:0.4:0.4, while the additive compositions of Examples 3* and 4 contained the Mannich detergent, carrier fluid and polybutene in a weight ratio of 1:0.4:0.4. The polybutenes set forth in the following Tables were as follows: H-40 PIB is a commercially available, conventional polyisobutene having a number average molecular weight of approximately 750 and a molecular weight distribution of 1.46; HR-PIB is a commercially available high-reactivity polyisobutene having a number average molecular weight of approximately 1000 and a molecular weight distribution of 1.34; H-40 NC is a narrow cut (i.e., the product of a high purity refinery stream) polyisobutene having a number average molecular weight of approximately 700 and a molecular weight distribution of 1.35. The amount (mg) of deposit on the intake valves is reported, a difference of 15 mg or more is considered statistically significant.

TABLE 1

| Example | Polyalkene | Treat (PTB) | IVD (mg) |
|---|---|---|---|
| 1* | H-40 PIB | 53.2 | 73.2 |
| 2 | HR-PIB | 53.2 | 54.8 |
| 3* | H-40 PIB | 67.9 | 89.2 |
| 4 | H-40 NC | 67.9 | 70.2 |

*Comparative Example

It is clear from the above data that compositions containing the polybutenes of the present invention, i.e., those polybutenes having a molecular weight distribution below 1.4, exhibit significantly reduce intake valve deposits compared to compositions containing a polybutene outside the scope of the present invention (Examples 1* and 3*).

Table 2 summarizes the results of a group of standard tests in which compositions of this invention were compared to compositions outside the scope of this invention in preventing valve sticking. The test procedures give either a pass or a fail rating. In all tests the Mannich detergent and the polyol carrier fluid were the same as used in Examples 3* and 4 above, the polybutenes were as set forth in the table and the weight ratio of the components was 1:0.4:0.4, respectively. Two different tests for measuring valve sticking were used.

The 5.0 L GM is a valve-sticking test run in a Chevrolet 5.0L V-8 truck (1995 Chevrolet C-1500) equipped with an automatic transmission. The test length is four days. The driving cycles consist of driving 56 minutes at 55 MPH with a 3 minute idle period and a 1 minute period for accelerating/decelerating. Mileage accumulation is performed on a chassis dynamometer. Day 1 operates on base fuel without additive. Days 2–4 operate on base fuel treated with additive. One day of tests consists of 4 driving cycles (4 hours) followed by a 16 hour soak at −4° F. Compression pressure is measured at the end of the soak. Zero compression indicates that intake valve sticking has occurred. No sticking after three days on base fuel with additive is a pass. Sticking on any day is a fail.

The Vanagon is a valve-sticking test run in a Volkswagon Vanagon equipped with a four-speed manual transmission. The test length is three days. The driving cycles consist of driving at 28 MPH for 6 minutes, 31 MPH for 5 minutes followed by an engine-off soak for 10 minutes. Mileage accumulation is performed on a chassis dynamometer. One day of tests consists of 13 test cycles (4.5 hours) followed by a 16 hour soak at 0° F. Compression pressure is measured at the end of the soak. Zero compression indicates that intake valve sticking has occurred. No sticking after three days is a pass. Sticking on any day is a fail.

TABLE 2

| Example | Test | Polyalkene | Treat (PTB) | Result |
|---|---|---|---|---|
| 5* | 5.0 L GM | H-40 PIB | 139 | FAIL |
| 6 | 5.0 L GM | H-40 NC PIB | 139 | PASS |
| 7* | Vanagon | H-40 PIB | 100 | FAIL |
| 8 | Vanagon | HR-PIB | 100 | PASS |

It will be noted that the compositions containing the polybutenes of the present invention (Examples 6 and 8) gave passing results in both tests, while the compositions containing a polybutene outside the scope of the present invention failed.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fiel-soluble" or "gasoline-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

We claim:

1. A fuel composition comprising (a) a spark-ignition fuel;

(b) a Mannich detergent; and (c) a polybutene having a molecular weight distribution of less than 1.4

2. The fuel composition according to claim 1 wherein the spark-ignition fuel comprises gasoline.

3. The fuel composition according to claim 1 wherein the spark-ignition fuel comprises a blend of hydrocarbons of the gasoline boiling range and a fuel-soluble oxygenated compound.

4. The fuel composition according to claim 1 wherein the polybutene has a number average molecular weight of from 500 to about 2000.

5. The fuel composition according to claim 1 wherein the polybutene is polybutene obtained from a high purity refinery stream.

6. The fuel composition according to claim 4 wherein the polybutene is a high-reactivity polyisobutene.

7. The fuel composition according to claim 1 wherein the Mannich detergent comprises the reaction product of at least one alkyl-substituted hydroxyaromatic compound, an aldehyde and at least one amine.

8. The Mannich detergent of claim 7 wherein the alkyl-substituted hydroxyaromatic compound is an alkyl-substituted phenol.

9. The Mannich detergent of claim 8 wherein the alkyl-substituted phenol is a polybutylphenol.

10. The Mannich detergent of claim 8 wherein the alkyl-substituted phenol is a polypropylphenol.

11. The Mannich detergent of claim 7 wherein the alkyl-substituted hydroxyaromatic compound is an alkyl-substituted cresol.

12. The Mannich detergent of claim 7 wherein the amine comprises at least one alkylene polyamine.

13. The Mannich detergent of claim 7 wherein the amine comprises at least one aliphatic diamine having one primary or one secondary amino group and one tertiary amino group in the molecule.

14. The Mannich detergent of claim 13 wherein the aliphatic diamine is N,N-dimethyl-1,3-propanediamine.

15. The fuel composition according to claim 1 further comprising a carrier fluid selected from the group consisting of 1) a mineral oil or a blend of mineral oils that have a viscosity index of less than about 120, 2) one or more poly-α-olefin oligomers, 3) one or more poly (oxyalkylene) compounds having an average molecular weight in the range of about 500 to about 3000, 4) polyalkenes, other than polybutenes having a MWD of 1.4 or less, and 5) a mixture of any two, three or all four of 1), 2), 3) and 4).

16. The fuel composition according to claim 15 wherein the carrier fluid comprises at least one poly (oxyalkylene) compound.

17. The fuel composition according to claim 1 further comprising at least one additive selected from the group consisting of additional dispersants/detergents, antioxidants, carrier fluids, metal deactivators, dyes, markers, corrosion inhibitors, biocides, antistatic additives, drag reducing agents, demulsifiers, dehazers, anti-icing additives, anti-knock additives, anti-valve-seat recession additives, lubricity additives and combustion improvers.

18. A method of minimizing or reducing intake valve deposits in a spark-ignition internal combustion engine said method comprises providing as fuel for the operation of said engine a fuel composition in accordance with claim 1.

19. A method of minimizing or reducing intake valve deposits in a spark-ignition internal combustion engine, said method comprises providing as fuel for the operation of said engine a fuel composition in accordance with claim 15.

20. A method of minimizing or eliminating valve sticking in a spark-ignition internal combustion engine, said method comprises providing as fuel for the operation of said engine a fuel composition in accordance with claim 1.

21. A method of minimizing or eliminating valve sticking in a spark-ignition internal combustion engine, said method comprises providing as fuel for the operation of said engine a fuel composition in accordance with claim 15.

22. An additive concentrate comprising:

(i) a polybutene having a molecular weight distribution of less than 1.4;

(ii) a Mannich detergent; and (iii) a diluent;

wherein the ratio of (i):(ii) is from 0.1:1 to 1:1.

* * * * *